US006198469B1

(12) United States Patent
Tjandrasuwita

(10) Patent No.: US 6,198,469 B1
(45) Date of Patent: Mar. 6, 2001

(54) "FRAME-RATE MODULATION METHOD AND APPARATUS TO GENERATE FLEXIBLE GRAYSCALE SHADING FOR SUPER TWISTED NEMATIC DISPLAYS USING STORED BRIGHTNESS-LEVEL WAVEFORMS"

(76) Inventor: Ignatius B. Tjandrasuwita, 32421 Seaside Dr., Union City, CA (US) 94587

( * ) Notice: Subject to any disclaimer, the term of this patent is extended or adjusted under 35 U.S.C. 154(b) by 0 days.

(21) Appl. No.: 09/108,258

(22) Filed: Jul. 1, 1998

(51) Int. Cl.[7] ..... G09G 5/10; G09G 3/36
(52) U.S. Cl. ..... 345/147; 345/89
(58) Field of Search ..... 345/89, 88, 94, 345/100, 147, 103, 148, 95, 149, 186, 204, 199, 208, 210

(56) References Cited

U.S. PATENT DOCUMENTS

| | | | | |
|---|---|---|---|---|
| 4,819,186 | | 4/1989 | Ohta et al. | 364/519 |
| 5,122,783 | * | 6/1992 | Bassetti, Jr. | 345/147 |
| 5,185,602 | | 2/1993 | Bassetti et al. | 340/793 |
| 5,196,839 | * | 3/1993 | Johary et al. | 345/148 |
| 5,293,159 | * | 3/1994 | Bassetti, Jr. et al. | 345/149 |
| 5,298,915 | * | 3/1994 | Bassetti, Jr. | 345/149 |
| 5,313,224 | * | 5/1994 | Singhal et al. | 345/89 |
| 5,321,418 | * | 6/1994 | Leroux | 345/89 |
| 5,389,948 | * | 2/1995 | Liu | 345/147 |
| 5,543,819 | * | 8/1996 | Farwell et al. | 345/147 |
| 5,712,651 | * | 1/1998 | Tomiyasu | 345/147 |
| 5,777,590 | * | 7/1998 | Saxena et al. | 345/89 |
| 5,892,496 | * | 4/1999 | Wakeland | 345/147 |
| 6,008,794 | * | 12/1999 | Ishii | 345/147 |
| 6,043,801 | * | 3/2000 | Bassetti | 345/89 |

FOREIGN PATENT DOCUMENTS

| | | | |
|---|---|---|---|
| 0 837 444 | 9/1997 | (EP) | G09G/3/36 |

* cited by examiner

*Primary Examiner*—Dennis-Doon Chow
*Assistant Examiner*—Paul A. Bell
(74) *Attorney, Agent, or Firm*—Nguyen & Associates

(57) ABSTRACT

A apparatus to generate gray scale shading data in response to input color data that is cost efficient and programmable is presented. The present invention allows up to 16 brightness-levels to be generated per color (e.g., Red, Green, and Blue). Under the present invention, each color pixel can be programmed to have one of the 16 brightness-level waveforms stored in a memory by dynamically changing a number of variables such as pixel color offsets, frame offset, column offset, row offset, pixel mapping data, etc. An accessing waveform index is generated from the above variables which is then used to select a brightness-level waveform from the memory. The brightness-level waveforms stored in the memory are also programmable.

24 Claims, 11 Drawing Sheets

"FRAME-RATE MODULATION METHOD AND APPARATUS TO GENERATE FLEXIBLE GRAYSCALE SHADING FOR SUPER TWISTED NEMATIC DISPLAYS USING STORED BRIGHTNESS-LEVEL WAVEFORMS"

FIELD OF THE INVENTION

The invention generally relates to gray scale shading on digitally controlled displays, and more particularly relates to a frame-rate modulation technique for passive matrix Liquid Crystal Displays (LCD) which are also called super twisted nematic (STN) LCD displays.

BACKGROUND OF THE INVENTION

Unlike conventional Cathode Ray Tubes (CRTs) whose color brightness level and therefore color intensity can be controlled by varying an analog brightness control voltage at the grid electrode of the tube while the electron beam is swept across different pixel positions of a display line, digitally controlled displays such as Liquid Crystal Display (LCD) lack an analog control electrode similar to the grid electrode of a CRT. For this reason, a number of techniques have been utilized to control the pixel color intensity in LCDs.

For Super Twisted Nematic (STN) LCDs (i.e., passive matrix LCDs), since only one-bit, which translates to 2 graylevels, is required for each color, Red, Green, and Blue, a total of eight display colors is possible. As such, a pixel brightness control technique known as the 'frame-rate modulation' method is used to generate more gray-levels per color and therefore more number of colors in total for the display panel. Generally, in the frame-rate modulation method, the frequency of pixel energizing pulses sent to the power lines associated with the corresponding pixels is varied to control the color intensity. In other words, the color intensity (gray-level) depends on how often the pixel is turned on.

More particularly, in a traditional frame-rate modulation method, a mathematical formula is typically used to generate the frame-rate modulation data. With a mathematical formula, while some programmability and flexibility may be possible, the flexibility is rather limited. The reason is the range of frame rate modulation data is mathematically limited by the formula itself. Such limitation may in turn reduce the performance of the frame-rate modulation method. More specifically, since the levels of intensity available for each display color may be limited, the ability to prevent visual disturbances such as flickering may be reduced, etc.

Prior-art attempts to improve the performance of traditional frame-rate modulation methods include the approach of U.S. Pat. No. 5,185,602 wherein the energization of spatially adjacent pixels is scattered in time and pixels which are energized at the same time are spatially scattered to avoid the perception of visual disturbances such as flickering and movie marquee effect.

In U.S. Pat. No. 5,185,602, brightness-setting signals each having a brightness level associated with them are stored in a waveform memory. The brightness levels are assigned to predetermined areas of the display panel. The brightness levels are stored in an image memory and whose locations are identified by the display row and column numbers. A phase placement pattern (matrix) of D×D cells that corresponds to each brightness level is created to map the frame number that an individual pixel is to be energized.

Accordingly, there are D frames associated with each phase placement pattern. In so doing, the energization of spatially adjacent pixels is scattered in time and pixels which are energized at the same time are spatially scattered to avoid the perception of visual disturbances. The phase placement patterns are predetermined to minimize visual disturbances. All the phase placement patterns are then stored in a pattern memory which as a result may be sizable.

Each cell in a phase placement pattern corresponds to a pixel and can be accessed by the row and column modulo-D based numbers, the frame number, and the brightness level. Next, the desired brightness-setting signal is retrieved from the waveform memory by the brightness level and its corresponding energized bit can be extracted using an bit position signal output from the pattern memory.

As demonstrated above, the method of U.S. Pat. No. 5,185,602 and its hardware implementation are complex and expensive to implement. At the same time, the flexibility afforded by it is somewhat limited because the frame-rate modulation data is essentially predetermined by the phase placement patterns. While some programming capabilities exist for varying the frame-rate modulation data, such variation can not be easily performed given the inherent characteristics and requirements of the phase placement patterns. As a result, under U.S. Pat. No. 5,185,602, the capability to adapt to different passive matrix LCD panels is limited.

Thus, a need exists for a frame-rate modulation apparatus and method that are simple, cost-effective, and can easily be adapted to different passive matrix LCD panels.

SUMMARY OF THE INVENTION

Accordingly, the present invention provides a frame-rate modulation apparatus and method that are simple, cost-effective and can easily be adapted to different passive matrix LCD panels which are also called Super-twisted Nematic (STN) LCD panels.

The present invention meets the above need with an apparatus to generate frame-rate modulation data in response to input color pixel data for a digital display whose pixels are arranged in rows and columns. In the present invention, pixels are arranged into tiles each of which has a predetermined number of pixels. The apparatus comprises a first memory, an index generating circuit that is coupled to the first memory, a frame counter, a horizontal pixel counter, and a vertical line counter, a second memory, and a multiplexing circuit that is coupled to the second memory and the index generating circuit.

The first memory receives as input pixel mapping data values. In response to row and column addresses, the first memory selects pixel mapping data values received for output. The second memory stores a predetermined number of brightness-level waveforms each of which has a predetermined number of command bits corresponding to the frames in a frame cycle associated with the waveforms. The index generating circuit generates a waveform accessing index based on a horizontal pixel count, a vertical line count, a frame count, pixel mapping data, and pixel color offset values. The waveform accessing index is provided to the multiplexing circuit. In response to the waveform accessing index and input pixel color data, the multiplexing circuit selects for output a brightness-level waveform from the second memory for driving a super twisted nematic liquid crystal display.

The apparatus in accordance to the present invention may further comprises a mode selecting circuit which selects pixel color data for output to the multiplexing circuit according to a predetermined scheme in response to a mode select signal.

All the features and advantages of the present invention will become apparent from the following detailed description of its preferred embodiment whose description should be taken in conjunction with the accompanying drawings.

DETAILED DESCRIPTION OF THE INVENTION

In the following detailed description of the present invention, numerous specific details are set forth in order to provide a thorough understanding of the present invention. However, it will be obvious to one skilled in the art that the present invention may be practiced without these specific details. In other instances well known methods, procedures, components, and circuits have not been described in detail as not to unnecessarily obscure aspects of the present invention. While the following detailed description of the present invention describes its application to color displays, it is to be appreciated that the present invention is also applicable to monochrome displays. Moreover, while the following detailed description of the present invention describes primarily a hardware implementation, it should be clear to a person of ordinary skill in the art that a software implementation of the present invention is also within the scope of this invention.

In accordance to an embodiment of the present invention, gray scale shading data can be generated in response to input color data in a cost efficient and flexible (programmable) manner. Under the present invention, up to 16 brightness-levels can be generated per color (e.g., Red, Green, and Blue). Each color pixel can be programmed to have one of the 16 brightness-level waveforms stored in a memory by dynamically changing a number of variables such as pixel color offsets, frame offset, column offset, row offset, pixel mapping data, etc. An accessing waveform index is generated from the above variables which is then used to select a brightness-level waveform from the memory. The brightness-level waveforms stored in the memory are also programmable. In so doing, the present invention is easy to implement and can easily be adapted to different types of passive matrix LCDs.

Figure 1:
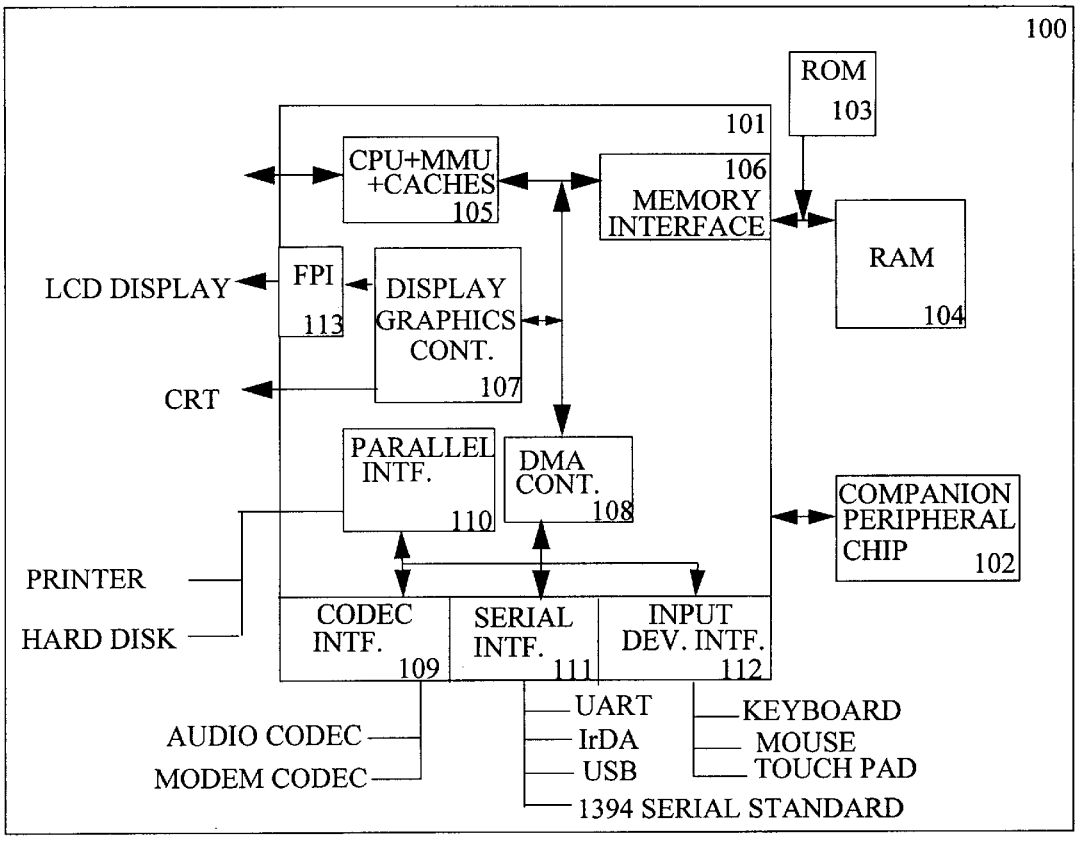
FIG. 1 is a high-level block diagram illustrating a typical computer system that implements the present invention.

FIG. 1 illustrates, for example, a high-level diagram of computer system 100 upon which the present invention may be implemented or practiced. More particularly, computer system 100 may be a lap-top or hand-held computer system. It is to be appreciated that computer system 100 is exemplary only and that the present invention can operate within a number of different computer systems including desk-top computer systems, general purpose computer systems, embedded computer systems, and others where STN LCD panels are used.

As shown in FIG. 1, computer system 100 is a highly integrated system which includes integrated processor circuit 101, peripheral controller 102, read-only-memory (ROM) 103, and random access memory (RAM) 104. The highly integrated architecture allows power to be conserved. Computer system architecture 100 may also include a peripheral controller if there is a need to interface with complex and/or high pin-count peripherals that are not provided in integrated processor circuit 101.

While peripheral controller 102 is connected to integrated processor circuit 101 on one end, ROM 103 and RAM 104 are connected to integrated processor circuit 101 on the other end. Integrated processor circuit 101 comprises a processing unit 105, memory interface 106, graphics/display controller 107, direct memory access (DMA) controller 108, and core logic functions including encoder/decoder (CODEC) interface 109, parallel interface 110, serial interface 111, input device interface 112, and flat panel interface (FPI) 113. Processing unit 105 consists of a central processing unit (CPU), a memory management unit (MMU), together with instruction/data caches.

CODEC interface 109 provides the interface for an audio source and/or modem to connect to integrated processor circuit 101. Parallel interface 110 allows parallel input/output (I/O) devices such as hard disks, printers, etc. to connect to integrated processor circuit 101. Serial interface 111 provides the interface for serial I/O devices such as universal asynchronous receiver transmitter (UART) to connect to integrated processor circuit 101. Input device interface 112 provides the interface for input devices such as keyboard, mouse, and touch pad to connect to integrated processor circuit 101.

DMA controller 108 accesses data stored in RAM 104 via memory interface 106 and provides the data to peripheral devices connected to CODEC interface 109, parallel interface 110, serial interface 111, or input device interface 112. Graphics/display controller 107 requests and accesses the video/graphics data from RAM 104 via memory interface 106. Graphics/display controller 107 then processes the data, formats the processed data, and sends the formatted data to a display device such as a liquid crystal display (LCD), a cathode ray tube (CRT), or a television (TV) monitor.

If the display device is a LCD, processed data from graphics/display controller 107 is first sent to flat panel interface 113 before being passed on to the LCD. Flat panel interface 113 further processes the data by further adding different color hues or gray shades for display. Additionally, depending on whether a thin film transistor (TFT) LCD (a.k.a., active matrix LCD) or a super twisted nematic (STN) LCD (a.k.a., passive matrix LCD) is used, flat panel interface 113 formats the data to suit the type of display. Furthermore, FPI 113 allows color data to be converted into monochrome data in the event a monochrome LCD is used. If the display device is a cathode ray tube (CRT), processed data is provided to a digital-to-analog converter (DAC) prior to being sent to the CRT. In computer system 100, a single memory bus is used to connect integrated processor circuit 101 to ROM 103 and RAM 104.

Figure 2:
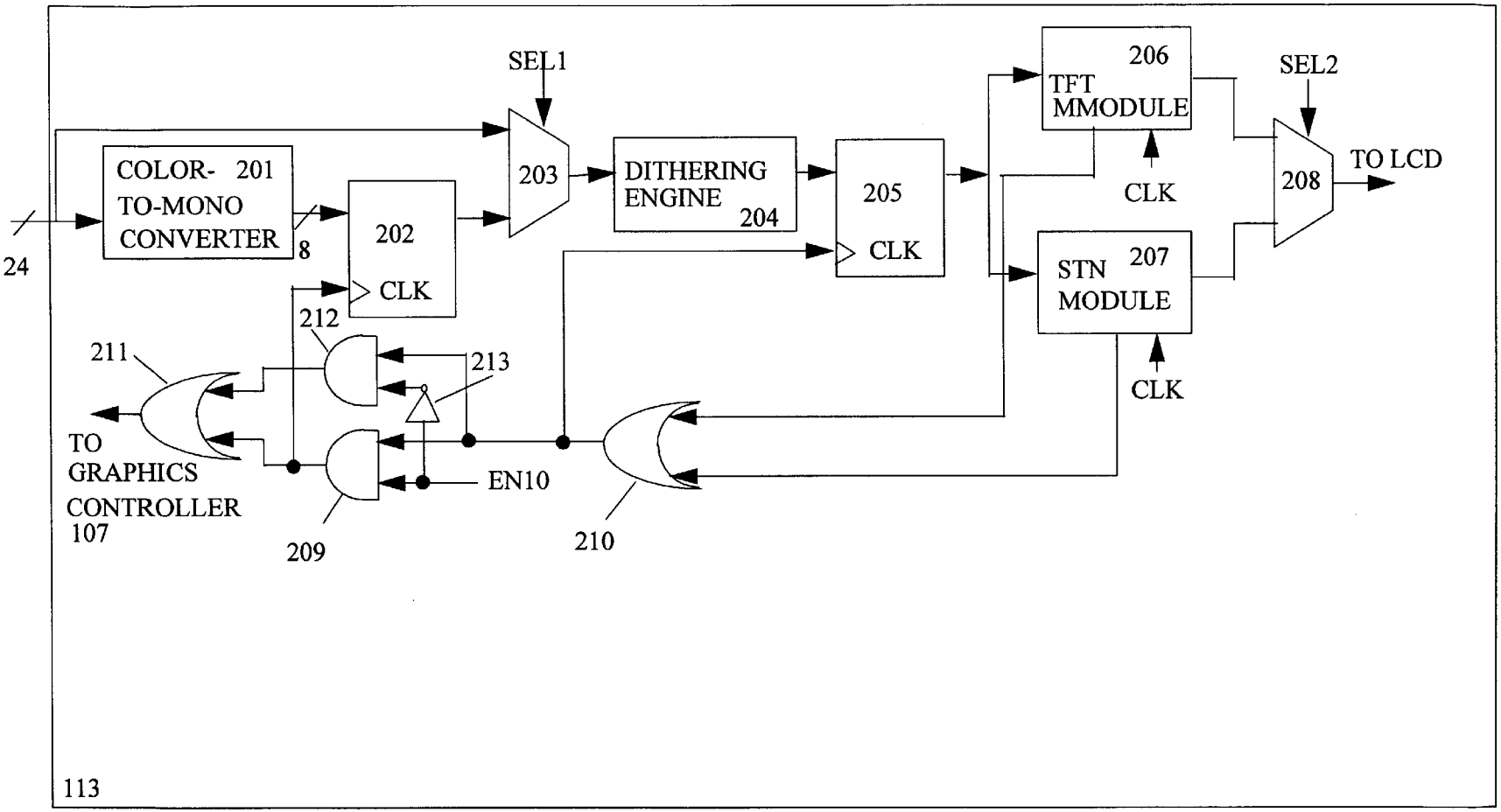
FIG. 2 is a block diagram illustrating in more details flat panel interface 113 of FIG. 1.

In accordance to an embodiment of the present invention, the invention is implemented as part of FPI 113. Reference is now made to FIG. 2 illustrating FPI 113 in more details. In general, FPI 113 consists of color-to-mono converter 201, latch circuit 202, multiplexor 203, dithering engine 204, latch circuit 205, TFT module 206, STN module 207, multiplexor 208, AND-gate 209, OR-gates 210–211, AND-gate 212, and inverter 213. Depending on the display mode selected by the user, either TFT module 206 or STN module 207 is utilized to format display data according to the desired display mode. In other words, the two data paths of TFT module 206 and STN module 207 receive data from a single source and operate (e.g., process and propagate data) mutually exclusively of each other.

Since FPI 113 allows the use of a monochrome display monitor with computer system 100 and display/graphics controller 107 generally processes display data as if they are color, color-to-mono converter 201 is used to convert color display data into monochrome display data. Hence, processed data from display/graphics controller 207 is first provided to color-to-mono converter 201. The output of color-to-mono converter 201 is provided to the input of latch circuit 202. Latch circuit 202 is capable of handling 8 data bits concurrently. It should be clear to a person of ordinary skill in the art that latch circuit 202 can easily be designed using a combination of D-type latches or other types of latches. Latch circuit 202 is driven by a propagated clock signal outputted from AND-gate 209. The inputs to AND-gate 209 are an enable signal EN10 and the propagated clock output of OR-gate 210. When enable signal E10 is HIGH, it indicates that color to monochrome conversion is enabled to drive a monochrome panel. Thus, operationally, AND-gate 209 outputs a HIGH signal when both the propagated clock signal and enable signal EN10 are HIGH. Otherwise, AND-gate 209 outputs a LOW signal. In other words, latch circuit 202 and AND-gate 209 combine to act as a clock gating circuitry to enable or disable color-to-monochrome converter 201.

As discussed below, the propagated clock signal outputted from AND-gate 209 may eventually be supplied to display/graphics controller 107. The reason is enable signal EN10 is also inverted by inverter 213 and provided to AND-gate 212. The second input provided to AND-gate 212 is the output of OR-gate 210. The outputs of AND-gates 209 and 212 are provided to OR-gate 211 which provides its output to an AND-gate of display/graphics controller 107. In so doing, a continuous propagated clock signal is ensured for display/graphics controller 107.

The output of latch circuit 202 is provided as an input to 2-to-1 multiplexor 203 which is controlled by select signal SELL that may originate, for example, from the control register (not shown) that is programmed by the CPU as indicated by the user. The other input of multiplexor 203 is the output from display/graphics controller 107. In so doing, FPI 113 can interface with both a color and a monochrome display.

The output of multiplexor 203 is provided to dithering engine 204 which performs a pixel operation to convey as accurately as possible the color of an image when the output color bits are fewer than what are required. In other words, dithering engine 204 essentially enhances the color of the displayed image. The output of dithering engine 204 is provided to latch circuit 205 which is driven by a propagated clock signal from OR-gate 210. The inputs of OR-gate 210 are two propagated clock signals from TFT module 206 and STN module 207. The output of latch circuit 205 is provided simultaneously to both TFT module 206 and STN module 207. In so doing, FPI 113 can operate either an active-matrix (TFT) display or a passive-matrix (STN) display wherein only one display mode can be selected at any given time. As such, FPI 113 has two separate internal data paths that are mutually exclusive of each other. The outputs of TFT module 206 and STN module 207 are provided as inputs to 2-to-1 multiplexor 208 which is controlled by a select signal SEL2 that may originate, for example, from the control register (not shown) that is programmed by the CPU as indicated by the user. The output of multiplexor 208 is provided to a LCD display monitor.

Operationally, OR-gate 210 outputs a HIGH signal when either the propagated clock signal from TFT module 206 or from STN module 207. Because TFT module 206 and STN module 207 are designed to function mutually exclusive of one another, except for some unforeseeable error condition, OR-gate 210 should not receive two HIGH signals concurrently as inputs. If both of its input signals are LOW, OR-gate 210 outputs a LOW signal. As such, latch circuit 205 and OR-gate 210 combine to act as a clock gating circuitry to enable dithering engine 204. While the clock gating circuitry in the present embodiment is implemented using AND-gates and enable signals (e.g., AND-gate 209 and enable signal EN10) as well as an OR-gate (e.g., OR-gate 211) with propagated clock signals generated from AND-gates in TFT module 206 and in STN module 207, it is clear to a person of ordinary skill in the art that a clock gating circuitry can equally be implemented using other combinational logic such as OR-gates and disable signals, an AND-gate with propagated clock signals from OR-gates, and other combinations of logic-gates.

Figure 3:
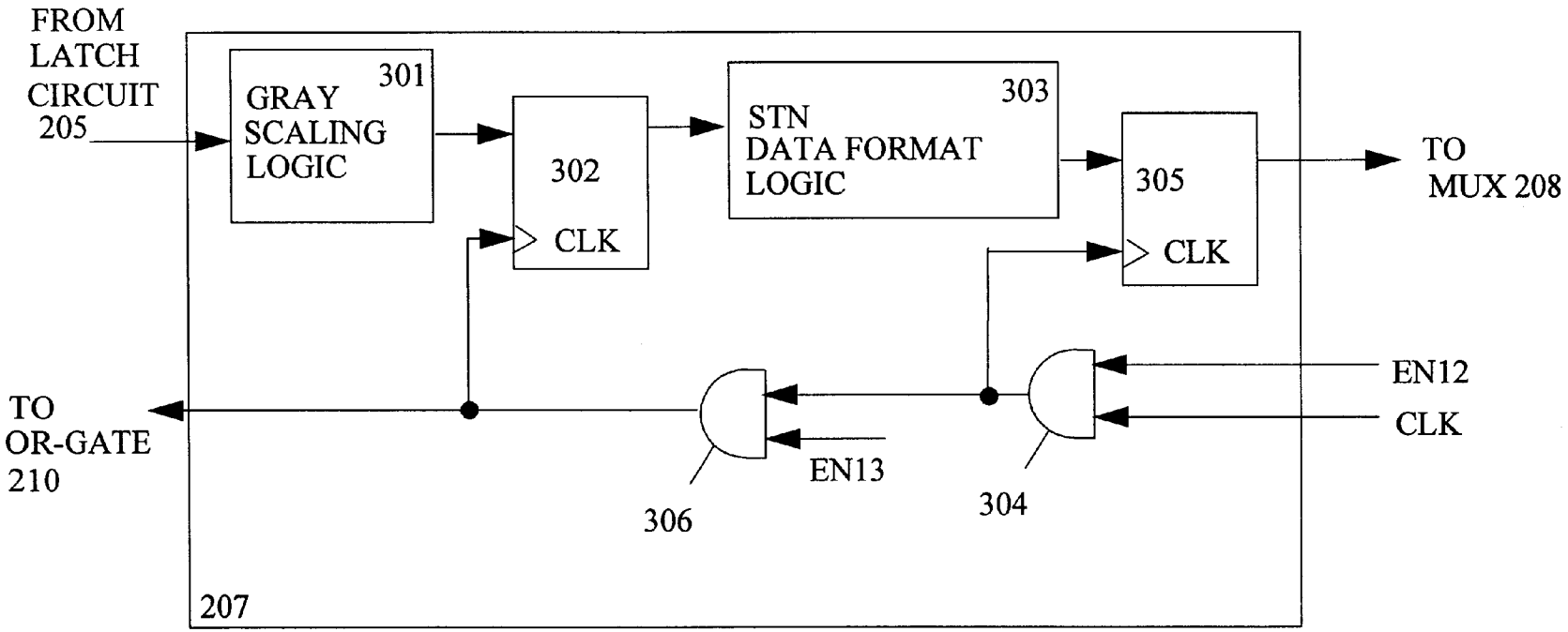
FIG. 3 is a block diagram illustrating in more details Super Twisted Nematic (STN) LCD module 207 of FIG. 2.

Referring now to FIG. 3 illustrating in more detail STN module 207. As shown in FIG. 3, STN module 207 includes gray scaling logic 301, latch circuit 302, STN data format logic 303, AND-gate 304, latch circuit 305, and AND-gate 306. In the preferred embodiment, latch circuits 302 and 305 are D-type latches. However, it is to be appreciated that other latch types may be employed as well.

Gray scaling logic 301 receives as input color enhanced display data from latch circuit 205. Gray scaling logic 301 generates gray scale shadings using time or frame modulation technique. In a STN panel, each color-pixel is represented by 1-bit, the different gray shades can be generated by turning on and off the pixel. In other words, the brightness of a pixel depends on its energized duration and frequency. The output of gray scaling logic 301 is provided to latch circuit 302. Latch circuit 302 is used to control the flow of data into STN data format logic 303. It should be clear to a person of ordinary skill in the art that latch circuit 302 can easily be designed using a combination of D-type latches and other types of latches.

Latch circuit 302 is clocked by the output of AND-gate 306 which has as its inputs a propagated clock signal from AND-gate 304 and enable signal EN13 which may originate from a bit in the control register (not shown) that is programmed by the CPU of processing unit 105 as selected by the user or from a power management circuit (not shown). AND-gate 306 generates a HIGH signal when both the propagated clock signal and enable signal EN13 are HIGH. Otherwise, AND-gate 306 outputs a LOW signal. As such, AND-gate 306 and latch circuit 302 combine to act as the clock gating circuitry for gray scaling logic 301. The output of latch circuit 302 is provided as an input STN data format logic 303. STN data format logic 303 formats the data received according to STN display protocols and rules prior to sending the data to latch circuit 305 which is driven by the output of AND-gate 304.

AND-gate 304 receives as inputs clock signal CLK and enable signal EN12 which may originate from a bit in the control register (not shown) that is programmed by the CPU of processing unit 105 as selected by the user or from a power management circuit (not shown). AND-gate 304 generates a HIGH signal when both clock signal CLK and enable signal EN12 are HIGH. Otherwise, AND-gate 304 outputs a LOW signal. As such, AND-gate 304 and latch circuit 305 combine to act as the clock gating circuitry for STN data format logic 303.

Figure 4:
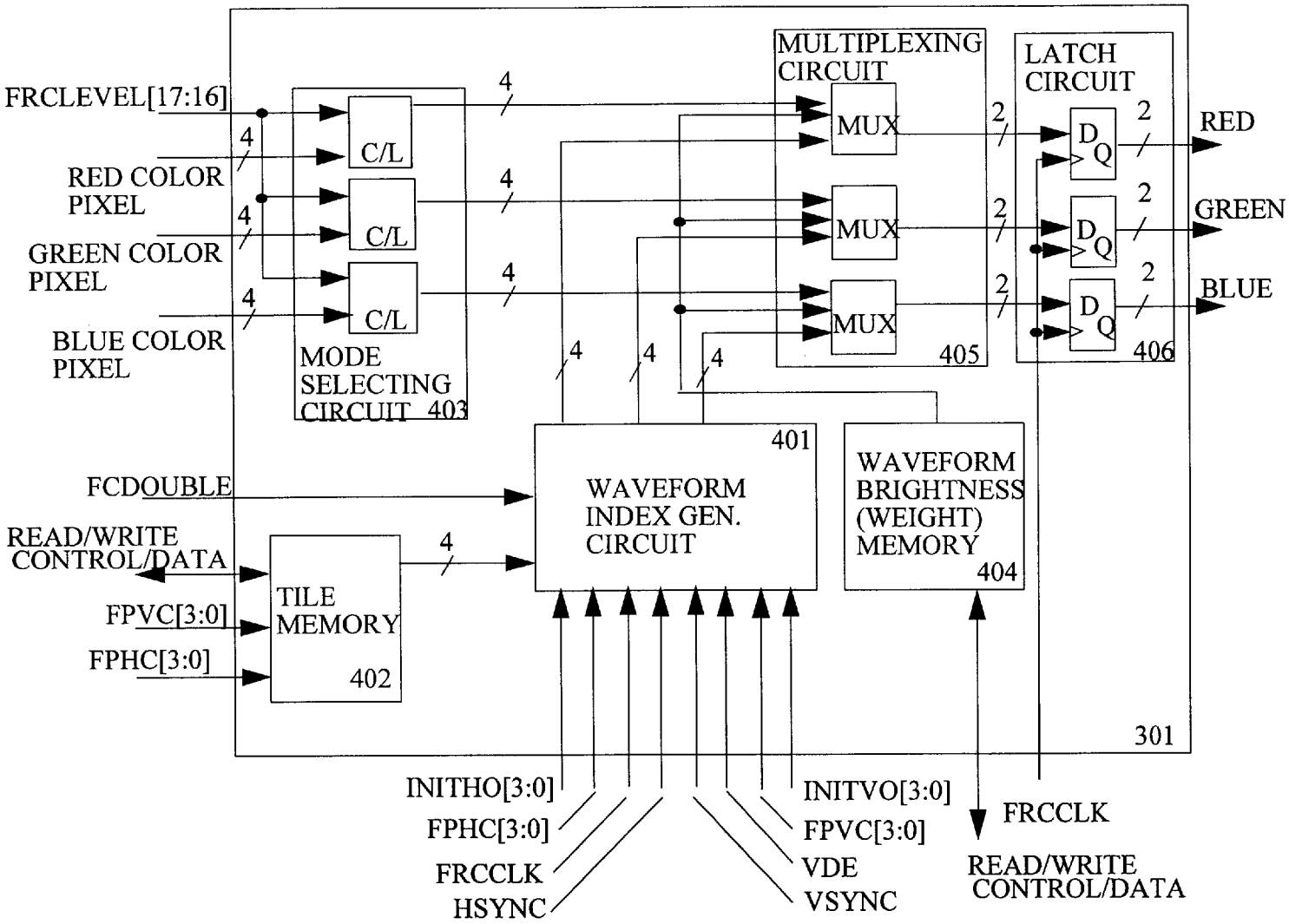
FIG. 4 is a block diagram illustrating the relevant components of gray scale logic 301 of FIG. 3 in accordance to the present invention.

Reference is now made to FIG. 4 illustrating a block diagram of the relevant components of gray scale logic 301. Gray scale logic 301 comprises waveform index generating circuit 401, tile memory 402, mode selecting circuit 403, brightness-level (weight) table 404, multiplexing circuit 405, and latch circuit 406.

As shown in FIG. 4, Red, Green, and Blue (RGB) color-pixel data from dithering engine 204 are provided as input to mode selecting circuit 403 wherein each pixel consists of 4 Red data bit Red data, 4 Green data bits, and 4 Blue data bits. Mode selecting circuit 403 also receives mode select signal FRCLEVEL[1:0] which indicates whether 2-, 4-, 8-, or 16-levels of gray scaling is desired. Depending on the value of mode select signal FRCLEVEL [1:0], mode selecting circuit 403 passes selected RGB color-pixel data to its output according to a predetermined scheme. Referring now to Table 1 which illustrates the scheme implemented by mode selecting circuit 403 in the current embodiment.

TABLE 1

| Color Input | FRCLEVEL [1:0] = 11 16-Levels Output | FRCLEVEL [1:0] = 10 8-Levels Output | FRCLEVEL [1:0] = 01 4-Levels Output | FRCLEVEL [1:0] = 00 2-Levels Output |
|---|---|---|---|---|
| 0000 | 0000 | 0000 | 0000 | 0000 |
| 0001 | 0001 | 0000 | 0000 | 0000 |
| 0010 | 0010 | 0010 | 0000 | 0000 |
| 0011 | 0011 | 0010 | 0000 | 0000 |
| 0100 | 0100 | 0100 | 0100 | 0000 |
| 0101 | 0101 | 0100 | 0100 | 0000 |
| 0110 | 0110 | 0110 | 0100 | 0000 |
| 0111 | 0111 | 0110 | 0100 | 0000 |
| 1000 | 1000 | 1000 | 1000 | 1111 |
| 1001 | 1001 | 1000 | 1000 | 1111 |
| 1010 | 1010 | 1010 | 1000 | 1111 |
| 1011 | 1011 | 1010 | 1000 | 1111 |
| 1100 | 1100 | 1100 | 1111 | 1111 |
| 1101 | 1101 | 1100 | 1111 | 1111 |
| 1110 | 1110 | 1111 | 1111 | 1111 |
| 1111 | 1111 | 1111 | 1111 | 1111 |

It is to be appreciated that the scheme implemented in Table 1 is but one of many mapping schemes that may be implemented under the present invention. Further, it is to be appreciated that under the present invention, a mapping scheme may be designed to be programmable as well. As shown in Table 1, since there are 16 possible gray-levels for each color inputs, if 16-levels of gray scale output is desired, all 16 color inputs are allowed to pass through as outputs. In other words, a one-to-one mapping scheme is performed under the 16-levels select mode.

If 8-levels of gray scale output is desired, the 16 possible gray-level inputs are mapped into 8 gray-level outputs according to the predetermined scheme shown in Table 1. In other words, a two-to-one mapping scheme is performed under the 8-levels select mode. More particularly, the output binary value 0000 is assigned to the input binary range 0000–0001, the output binary value 0010 is assigned to the input binary range 0010–0011, the output binary value 0100 is assigned to the input binary range 0100–0101, the output binary value 0110 is assigned to the input binary range 0110–0111, the output binary value 1000 is assigned to the input binary range 1000–1001, the output binary value 1010 is assigned to the input binary range 1010–1011, the output binary value 1100 is assigned to the input binary value 1100–1101, and the output binary value 1111 is assigned to the input binary range 1110–1111.

If 4-levels of gray scale output is desired, the 16 possible gray-level inputs are mapped into 4 gray-level outputs. In other words, a four-to-one mapping scheme is performed under the 4-levels select mode. More particularly, the output binary value 0000 is assigned to the input binary range 0000–0011, the output binary value 0100 is assigned to the input binary range 0100–0111, the output binary value 1000 is assigned to the input binary range 1000–1011, and the output binary value 1111 is assigned to the input binary range 1100–1111.

If 2-levels of gray scale output is desired, the 16 possible gray-level inputs are mapped into 2 gray-level outputs. In other words, an eight-to-one mapping scheme is performed under the 2-levels select mode. More particularly, the output binary value 0000 is assigned to the input binary range 0000–0111 and the output binary value 1111 is assigned to the input binary range 1000–1111.

In the current embodiment, Red, Green, and Blue color-pixel data streams are handled separately. As such, three substantially similar combinational logic circuit are used for mode selecting circuit 403 such that one combinational logic circuit is used in implementing the mode select mapping scheme of Table 1 for each color-pixel data stream.

Figure 4A:
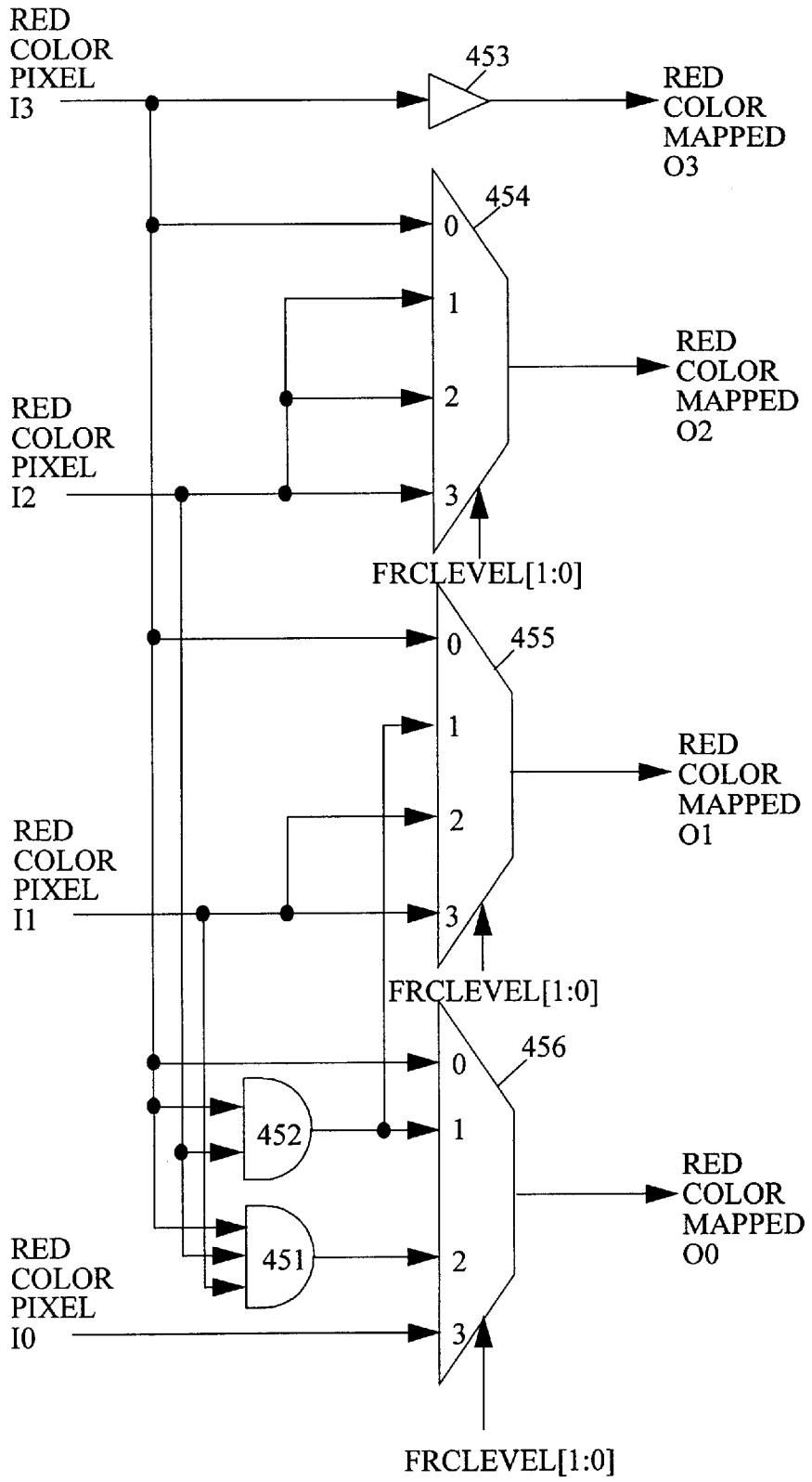
FIG. 4A illustrates an exemplary embodiment of the combinational logic circuit used in implementing the mode select mapping scheme of Table 1 for the Red color-pixel data stream

Referring now to FIG. 4A illustrating in more detail an embodiment of the combinational logic circuit used in implementing the mode select mapping scheme of Table 1 for the Red color-pixel data stream. As shown in FIG. 4A, the combinational logic consists of AND-gates 451–452, buffer 453, and 4-to-1 multiplexors 454–456. Bit 3, which is the most significant bit of the 4-bit Red color-pixel data input, is supplied as an input to delay buffer 453 which outputs bit 3 of the Red color mapped output. Multiplexor 454 receives as inputs the most significant bit of the 4-bit Red color-pixel data input (bit 3) and bit 2 of the 4-bit Red-pixel data input. As shown, bit 3 of the input is provided to input 0 of multiplexor 454 and bit 2 of the input is provided to inputs 1–3 of multiplexor 454. Signal FRCLEVEL[1:0] is provided to multiplexor 454 to use as a select signal.

Depending on the mode selected, multiplexor 454 selectively allows one of its inputs to pass through as its output. In particular, if signal FRCLEVEL[1:0] has the binary value '00', then input 0 of multiplexor 454 is provided as its output; if signal FRCLEVEL[1:0] has the binary value '01', then input 1 of multiplexor 454 is provided as its output; if signal FRCLEVEL[1:0] has the binary value '10', then input 2 of multiplexor 454 is provided as its output; and if signal FRCLEVEL[1:0] has the binary value '11', then input 3 of multiplexor 454 is provided as its output.

Multiplexor 455 receives as input bit 3 of the 4-bit Red color-pixel data input, the output of AND-gate 452, and bit 1 of the 4-bit Red color-pixel data input. More particularly, bit 3 is provided to input 0 of multiplexor 455, the output of AND-gate 452 is provided to input 1 of multiplexor 455, and bit 1 is provided to inputs 2–3 of multiplexor 455. Signal FRCLEVEL[1:0] is provided to multiplexor 455 to use as a select signal. Multiplexor 455 operates similarly to multiplexor 454. Depending on the mode selected, multiplexor 455 selectively allows one of its inputs to pass through as its output. Multiplexor 456 receives as input bit 3 of the 4-bit Red color-pixel data input, the output of AND-gate 452, the output of AND-gate 451, and bit 0 of the 4-bit Red color-pixel data input. More particularly, bit 3 is provided to input 0 of multiplexor 456, the output of AND-gate 452 is provided to input 1 of multiplexor 456, the output of AND-gate 451 is provided to input 2 of multiplexor 456, and bit 0 is provided to input 3 of multiplexor 456. Signal FRCLEVEL[1:0] is provided to multiplexor 456 to use as a select signal. Multiplexor 456 operates similarly to multiplexor 454. Depending on the mode selected, multiplexor 456 selectively allows one of its inputs to pass through as its output.

Bit 2 of the 4-bit Red color-pixel data input is also provided to the inputs of AND-gate 451 and 452. Bit 3 of the 4-bit Red color-pixel data input is also provided to the inputs of AND-gate 451 and 452. Bit 1 of the 4-bit Red color-pixel data input is also provided to the input of AND-gate 451. In so doing, the combinational logic circuit implements the mode select mapping scheme of Table 1 to the Red color-pixel data input. It should be clear to a person of ordinary skill in the art that similar combinational logic circuits can be used for the Green and Blue color-pixel data streams.

Figure 5:
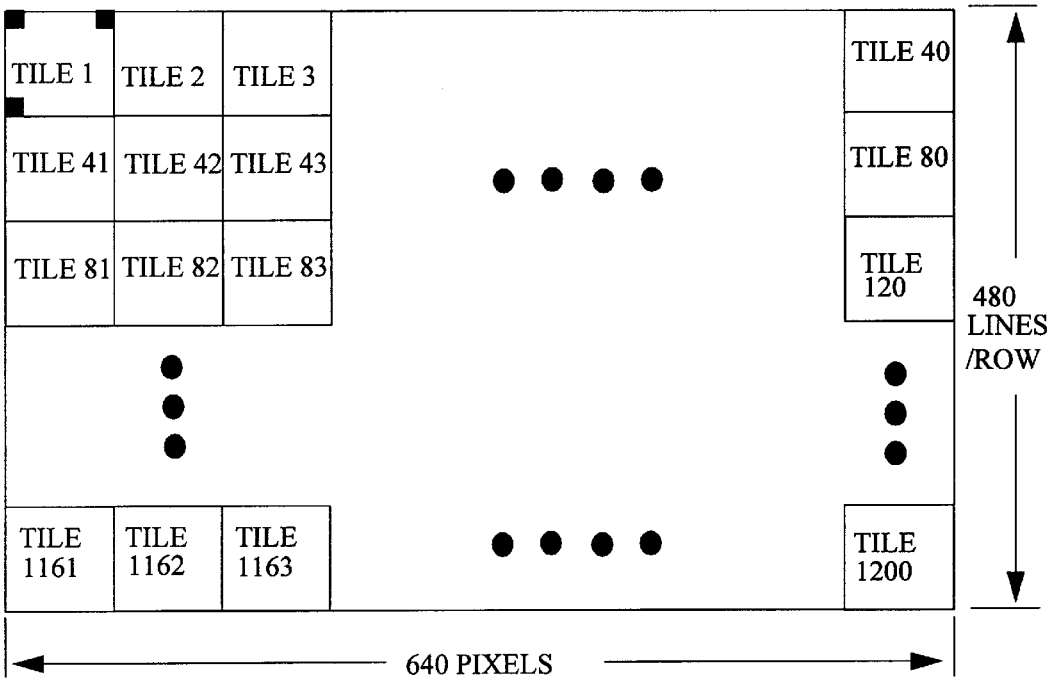
FIG. 5 illustrates, as an example, the subdivision of a 640×480 display area into tiles of a predetermined number of pixels in accordance to the present invention

In accordance to present invention, the display area is divided into tiles wherein each tile has a predetermined dimension of 16×16 pixels. It is to be appreciated that the display area can be divided into tiles of any size. Reference is now made to FIG. 5 illustrating, as an example, a 640×480 pixels display area that is divided into tiles in accordance to the present invention. As shown in FIG. 5, the tiles are numbered sequentially from left to right along each row and from top to bottom along each column.

Referring back to FIG. 4, pixel mapping data is sent to tile memory 402 from the CPU of processing unit 105 using READ/WRITE control/data signals. Pixel mapping data can be used as a variable to manipulate the waveform accessing index in selecting the desired brightness-level waveform for each pixel. Accordingly, new pixel mapping data is readily and easily programmed into tile memory 402. Hence, pixel mapping data represents a first programmable feature in the present invention. In the current embodiment, tile memory 402 is programmable and has the capacity to store 16×16 pixels each having 4 bits of data per pixel. Accordingly, each pixel can have a value ranging from 0-to-15. In other words, tile memory 402 can store pixel mapping data for an entire tile at any one time. Tile memory 402 also receives as inputs vertical line counter signal FPVC[3:0] and horizontal pixel counter signal FPHC[3:0] which are used as row and column addresses, respectively, to access pixel mapping data in tile memory 402. The accessed 4-bit pixel mapping data is provided as an input to waveform index generating circuit 401.

Waveform index generating circuit 401 also receives as inputs modulo-16 frame counter signal FPFC[3:0], frame counter doubling signal FCDOUBLE, programmable initial horizontal pixel offset value INITHO[3:0], modulo-16 horizontal pixel count FPHC[3:0], horizontal sync signal HSYNC, pixel clock signal FRCCLK, programmable initial vertical pixel offset value INITVO[3:0], modulo-16 vertical line count FPVC[3:0], vertical display (a.k.a. vertical active area) enable signal VDE, and vertical sync signal VSYNC. Using its inputs, waveform index generating circuit 401 determines a brightness-level waveform index that is used to access the desired brightness-level waveform to control the ON-OFF state of a pixel.

The brightness-level index from waveform index generating circuit 401 is provided as an input to multiplexing circuit 405. In addition to pixel-color data from mode selecting circuit 403, multiplexing circuit 405 also receives as input brightness-level waveform data from brightness-level (weight) memory 404. Using the brightness-level index and pixel-color data as select signals, multiplexing circuit 405 allows selected brightness-level waveform data to pass through to its outputs. In the current embodiment, Red, Green, and Blue color-pixel data streams are handled separately. As such, three substantially similar multiplexing logic circuits are used for multiplexing circuit 405 such that one multiplexing logic circuit is used for each color-pixel data stream.

Figure 4B:
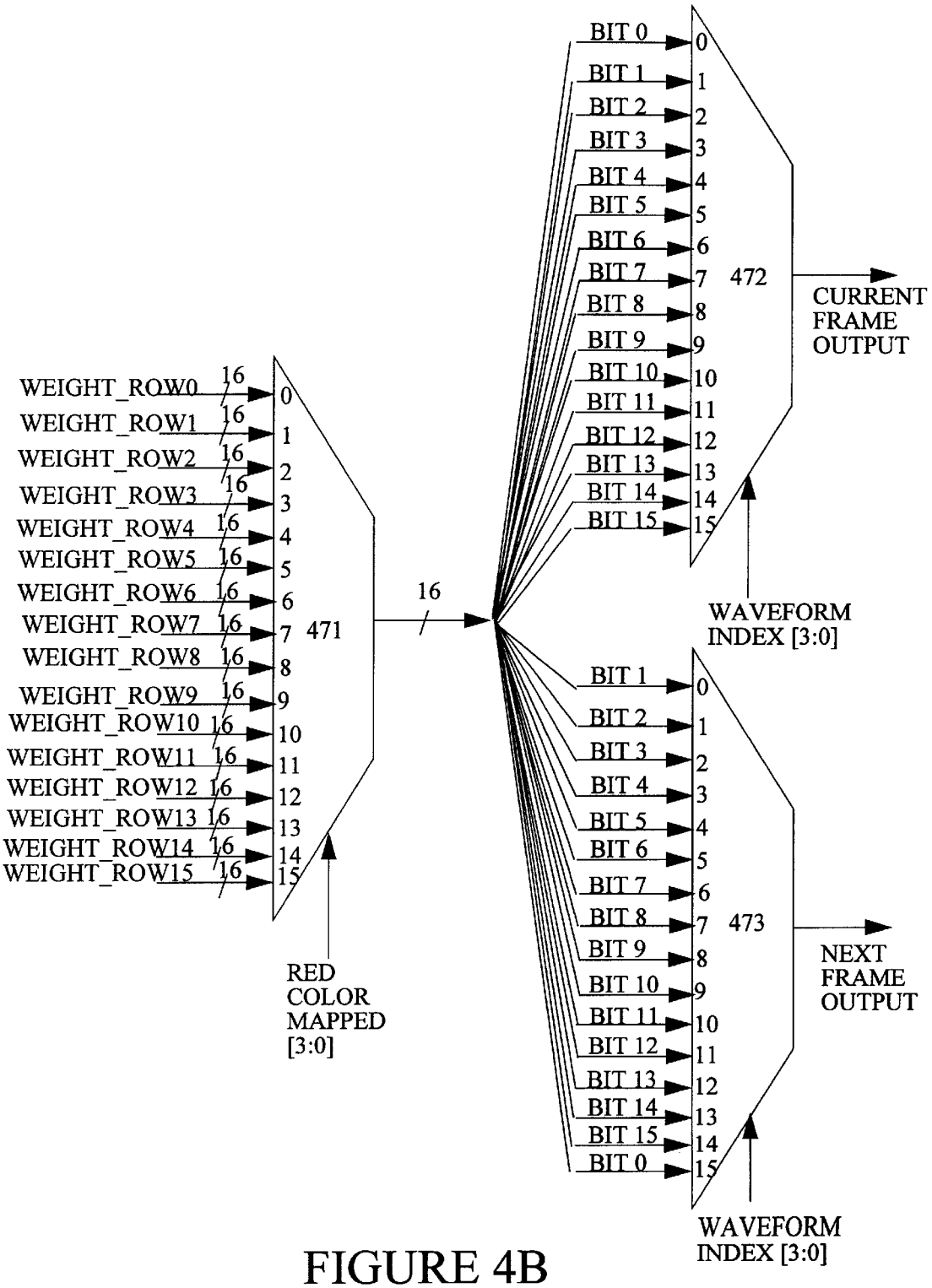
FIG. 4B illustrates an exemplary embodiment of a multiplexing logic circuit used for Red color brightness-level waveforms in multiplexing circuit 405.

Referring now to FIG. 4B illustrating in more detail an exemplary embodiment of a multiplexing logic circuit used for Red color brightness-level waveforms in multiplexing circuit 405. As shown in FIG. 4B, the multiplexing logic circuit consists of 16-to-1 multiplexors 471–473. Multiplexor 471 consists of sixteen 16-to-1 multiplexors. Multiplexor 471 receives as inputs the brightness-level waveforms of waveform brightness (weight) memory 404. More particularly, the content of each row of waveform brightness (weight) memory 404, which contains a different 16-bit brightness-level waveform, is provided as input to multiplexor 471. Red color mapped [3:0] signal generated by the combinational logic circuit of FIG. 4A is provided to multiplexor 471 as a select signal. In response to the Red color mapped [3:0] select signal, multiplexor 471 selects one of its inputs are passes it through as its output. In other words, depending on the input gray level out of 16 possible levels (e.g., from 0 to 15), the corresponding brightness-level waveform is outputted. The output of multiplexor 471, which is a 16-bit signal, is provided as inputs to multiplexors 472 and 473.

However, the order of the bits of the 16-bit signal is different for multiplexors 472 and 473. More particularly, for multiplexor 472, bit 0 (the least significant bit of the output of multiplexor 471) is provided to input 0 of multiplexor 472, bit 1 is provided to input 1 of multiplexor 472, bit 2 is provided to input 2 of multiplexor 472, and so on, bit 15 (the most significant bit of the output of multiplexor 471) is provided to input 15 of multiplexor 472. Conversely, for multiplexor 473, bit 1 is provided to input 0 of multiplexor 473, bit 2 is provided to input 1 of multiplexor 473, and so on, bit 15 is provided to input 14 of multiplexor 473, and bit 0 is provided to input 15 of multiplexor 473.

The waveform index [3:0] signal from waveform index generating circuit 401 is provided to multiplexors 472 and 473 as a select signal. In response to the waveform index [3:0] signal, multiplexors 472 and 473 selectively pass one their inputs through as their outputs. While the output of multiplexor 472 is provided to the half panel of a DSTN panel, the output of multiplexor 473 is provided to a half-frame buffer whose data is being used in the next frame. In so doing, the bit order change provides sequential frames with sequential Red color brightness-level waveform data that is necessary for an effect of continuity. The outputs of multiplexors 472 and 473 are referred to as Red color brightness-level waveform FCR and FNR signals, respectively. It should be clear to a person of ordinary skill in the art that similar multiplexing logic circuits can be used for the Green and Blue color brightness-level waveforms. In other words, similar multiplexing logic circuits can be used to generate Green color brightness-level waveform FCG and FNG as well as Blue color brightness-level waveform FCB and FNB signals (i.e., the Green and Blue equivalence of the FCR and FNR signals). In short, FCR, FCG, and FCB are Red, Green, and Blue color FRC outputs being sent to a half panel (used in the current frame) of a DSTN panel. On the other hand, FNR, FNG, and FNB are Red, Green, Blue FRC output being sent to a half-frame buffer for used in the next panel frame.

Referring now back to FIG. 4, in the present embodiment, each pixel-color gray scaling data (i.e., Red, Green, and Blue) consists of two bits data which are necessary for Dual Panel Dual Scan Super Twisted Nematic (DSTN) LCD panels. Each DSTN panel has an upper and a lower panel that are driven simultaneously. Accordingly, while data is being processed for one half-panel, a half-frame buffer is needed to supply the other half-panel with processed data. Hence, under the current embodiment, one data bit is sent to a half-panel (used in the current frame) and the other data bit is sent to a half-frame buffer (used in the next frame). For clarity and simplicity, the implementation of the half-frame buffer is not shown. It should be clear to a person of ordinary skill in the art that the present invention is equally applicable to single STN LCDs. For single panel STN LCDs, only FCR, FCG, and FCB data bits are used.

Referring now to Table 2 illustrating exemplary brightness-level waveforms stored in brightness-level (weight) memory 404. Under the present embodiment, weight memory 404 is a RAM having a capacity of 16×16 bits that can be programmed to suit the characteristics of the LCD or the requirements of the user. As such, weight table 404 can store up to 16 brightness-level waveforms each having a cycle of 16 frames. Each waveform is therefore indicative of the average brightness of the pixel over 16 frames. As shown in Table 2, each row of weight memory 404 contains a waveform of 16 command bits wherein each bit corresponds to the ON-OFF state of a pixel with respect to a time frame. The number of times a one (1) occurs in a waveform indicates the number of times the pixel is energized in 16 frames. Hence, a waveform can be programmed to have a desired number of ones (1 s) in 16 frames. In addition, the order that the ones appear and the spacing between the ones can also be programmed into a waveform. Furthermore, a waveform can also be defined in a non-sequentially increasing brightness manner. For example, the brightness-level 0000 can have the brightest intensity. Generally, an even distance between the ones (1 s) produces the best result. However, a great deal depends on the material of the panel itself. As demonstrated above, the brightness-level waveforms represent a second programmable feature in the present invention.

All the brightness-level waveforms in weight memory 404 are provided as inputs to multiplexor 471 of FIG. 4B. In particular, the brightness-level waveform in row 1 of Table 2 corresponds to WEIGHT_ROWO[0:15], the brightness-level waveform in row 2 of Table 2 corresponds to WEIGHT_ROW1[0:15], the brightness-level waveform in row 3 of Table 2 corresponds to WEIGHT_ROW2[0:15], etc.

TABLE 2

| Brightness | Frame No. | | | | | | | | | | | | | | | |
|---|---|---|---|---|---|---|---|---|---|---|---|---|---|---|---|---|
| (Weight) | 1 | 2 | 3 | 4 | 5 | 6 | 7 | 8 | 9 | 10 | 11 | 12 | 13 | 14 | 15 | 16 |
| 0000(0/16) | 0 | 0 | 0 | 0 | 0 | 0 | 0 | 0 | 0 | 0 | 0 | 0 | 0 | 0 | 0 | 0 |
| 0001(2/16) | 1 | 0 | 0 | 0 | 0 | 0 | 0 | 0 | 1 | 0 | 0 | 0 | 0 | 0 | 0 | 0 |
| 0010(3/16) | 1 | 0 | 0 | 0 | 0 | 1 | 0 | 0 | 0 | 0 | 1 | 0 | 0 | 0 | 0 | 0 |
| 0011(4/16) | 1 | 0 | 0 | 0 | 1 | 0 | 0 | 0 | 1 | 0 | 0 | 0 | 1 | 0 | 0 | 0 |
| 0100(5/16) | 1 | 0 | 0 | 1 | 0 | 0 | 1 | 0 | 0 | 1 | 0 | 0 | 1 | 0 | 0 | 0 |
| 0101(6/16) | 1 | 0 | 0 | 1 | 0 | 1 | 0 | 0 | 1 | 0 | 1 | 0 | 0 | 1 | 0 | 0 |
| 0110(7/16) | 1 | 0 | 1 | 0 | 1 | 0 | 1 | 0 | 0 | 1 | 0 | 1 | 0 | 1 | 0 | 0 |
| 0111(8/16) | 1 | 0 | 1 | 0 | 1 | 0 | 1 | 0 | 1 | 0 | 1 | 0 | 1 | 0 | 1 | 0 |
| 1000(9/16) | 0 | 1 | 0 | 1 | 0 | 1 | 0 | 1 | 1 | 0 | 1 | 0 | 1 | 0 | 1 | 1 |
| 1001(10/16) | 0 | 1 | 1 | 0 | 1 | 0 | 1 | 1 | 0 | 1 | 0 | 1 | 1 | 0 | 1 | 1 |
| 1010(11/16) | 0 | 1 | 1 | 0 | 1 | 1 | 0 | 1 | 1 | 0 | 1 | 1 | 0 | 1 | 1 | 1 |
| 1011(12/16) | 0 | 1 | 1 | 1 | 0 | 1 | 1 | 1 | 0 | 1 | 1 | 1 | 0 | 1 | 1 | 1 |
| 1100(13/16) | 0 | 1 | 1 | 1 | 1 | 0 | 1 | 1 | 1 | 1 | 0 | 1 | 1 | 1 | 1 | 1 |
| 1101(14/16) | 0 | 1 | 1 | 1 | 1 | 1 | 1 | 1 | 0 | 1 | 1 | 1 | 1 | 1 | 1 | 1 |
| 1110(15/16) | 0 | 1 | 1 | 1 | 1 | 1 | 1 | 1 | 1 | 1 | 1 | 1 | 1 | 1 | 1 | 1 |
| 1111(16/16) | 1 | 1 | 1 | 1 | 1 | 1 | 1 | 1 | 1 | 1 | 1 | 1 | 1 | 1 | 1 | 1 |

Figure 6:
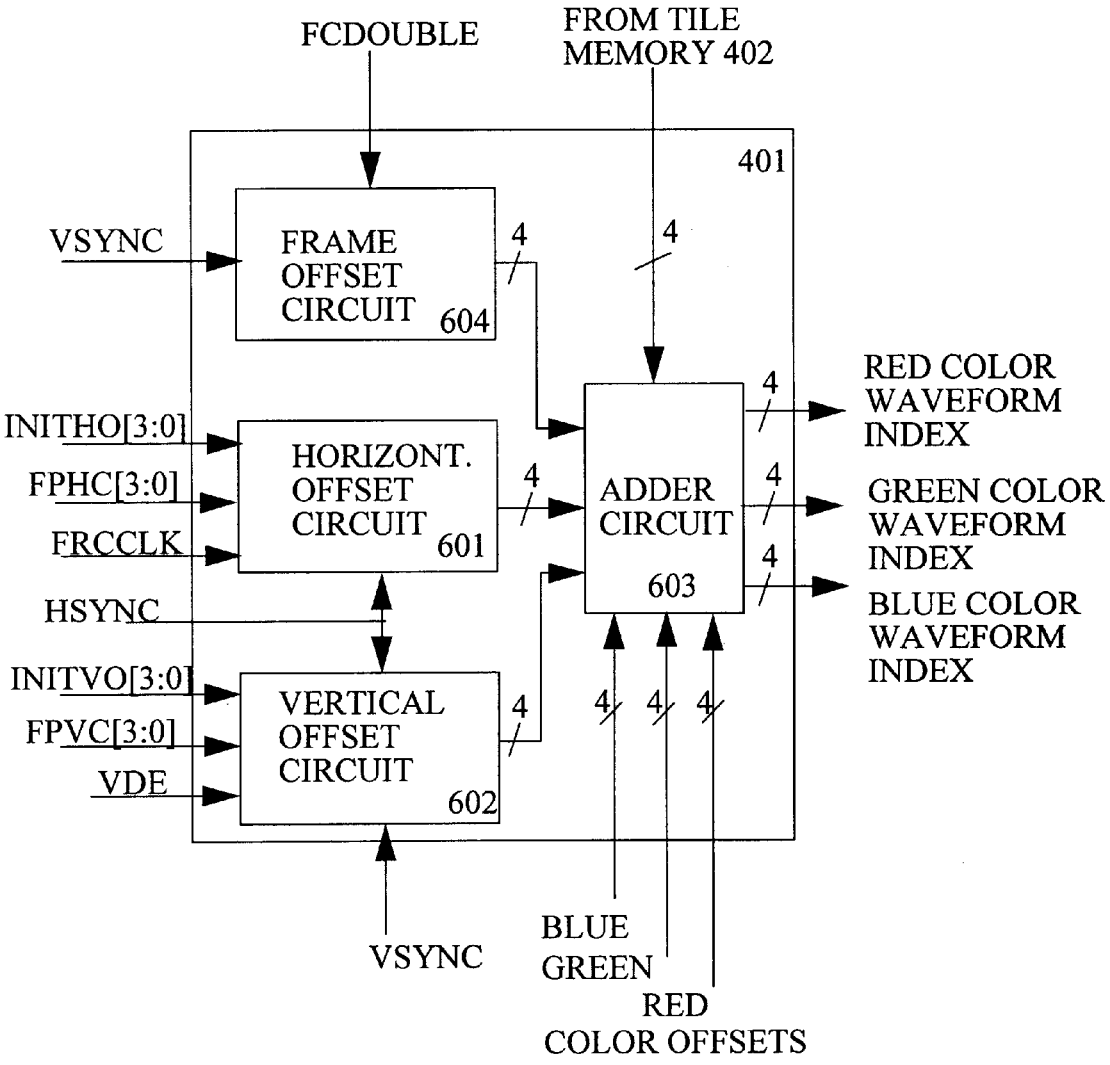
FIG. 6 is a block diagram illustrating waveform index generating circuit 401 of FIG. 4 in accordance to the present invention.

Reference is now made to FIG. 6 illustrating a block diagram of waveform index generating circuit 401. As shown in FIG. 6, waveform index generating circuit 401 consists of horizontal offset circuit 601, vertical offset circuit 602, adder circuit 603, and frame offset circuit 604. Frame offset circuit 604 receives as inputs vertical synch signal VSYNC and frame counter doubling signal FCDOUBLE which may come from a programmable register. Signal FCDOUBLE indicates whether the frame count output of frame offset circuit 604 is to be offset by the value '1' or '2'. The output of frame offset circuit 604 is a modulo-16 value which is consistent with the number of frames (16) in a brightness level waveform cycle. More particularly, if signal FCDOUBLE is LOW, the output of frame offset circuit counts by 1. Conversely, if signal FCDOUBLE is HIGH, the output of frame offset circuit 604 counts by 2.

Frame counter doubling signal FCDOUBLE is normally set LOW for single panel single scan STN LCD and is normally set HIGH for dual panel dual scan STN LCDs. The doubling of frame count for dual panel STN LCDs are usually needed because the flat panel interface outputs two frames of data at a time for dual panel STN LCDs. For dual panel DSTN, both upper and lower panel need to be driven simultaneously.

Figure 7:
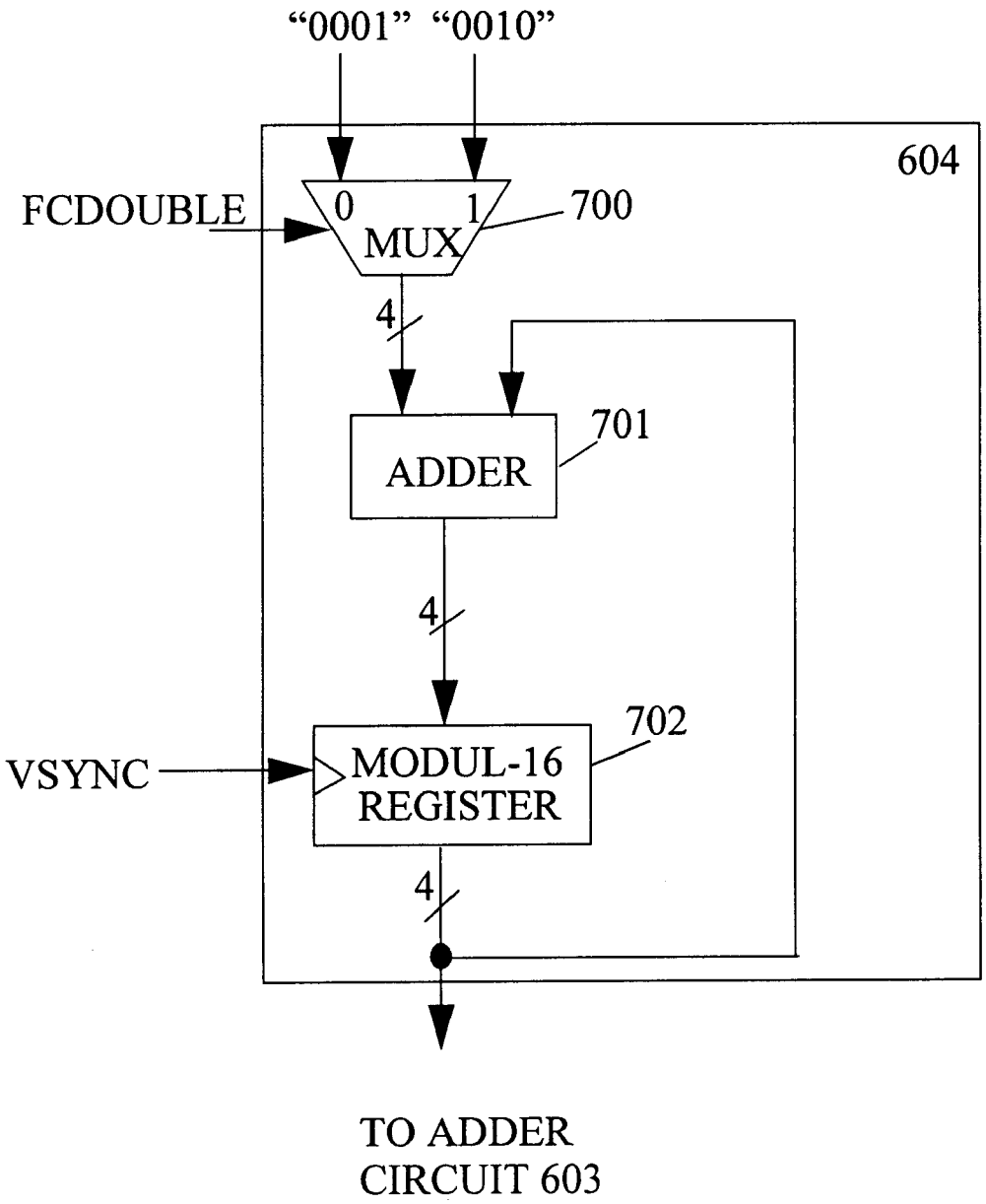
FIG. 7 is a block diagram illustrating frame offset circuit 604 of FIG. 6 in accordance to the present invention.

Reference is now made to FIG. 7 illustrating, as an example, frame offset circuit 604. As shown in FIG. 7, frame offset circuit 604 consists of multiplexor 700, adder 701, and modulo-16 register 702. Frame count signal FPFC[3:0] is sent to register 702 which is a 4-bit modulo-16 register used in monitoring the frame count. Register 702 is modulo 16 which matches the 16 frames of the brightness-level waveforms. Following this logic, if there are M frames in the brightness-level waveform, then register 702 needs to be a modulo-M register. Register 702 outputs its content to adder circuit 603. Additionally, register 702 provides its content as input to adder 701. Adder 701 receives as its other input the output of multiplexor 700. Multiplexor 700 receives as its inputs the binary values '0001' and '0010' as well as frame counter doubling signal FCDOUBLE as a select signal. Depending on frame counter doubling signal FCDOUBLE, multiplexor 700 passes either the binary values '0001' or '0010' to its output. Adder 701 adds the current value of register 702, to the output of multiplexor 700, which is the desired offset value, to determine the current frame offset value. The output of adder 701 is provided as input of modulo-16 register 702 which is clocked by VSYNC signal which is generated once per frame.

Figure 8:
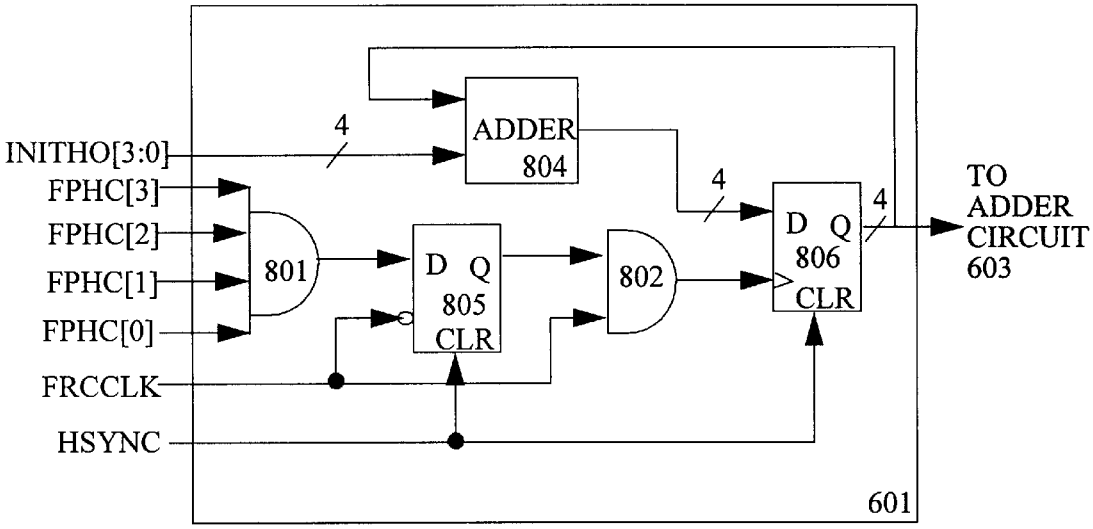
FIG. 8 is a block diagram illustrating horizontal offset circuit 601 of FIG. 6 in accordance to the present invention.

Referring now to FIG. 8 which illustrates horizontal pixel offset circuit 601. As shown in FIG. 8, horizontal pixel offset circuit 601 consists of AND-gates 801–802, adder 804, and latch circuits 805–806. Initial horizontal offset INITHO [3:0], which is a programmable 4-bit value that can be used to vary the output of horizontal pixel offset circuit 601, is provided as input to adder 804. The other input to adder 804 is the output of latch circuit 806. Horizontal pixel count signal FPHC[3:0] is provided as inputs to AND-gate 801. When the horizontal count reaches 15 indicating that the horizontal pixel boundary of a tile has been reached, AND-gate 801 outputs a HIGH signal. Otherwise, when the boundary has not been reached, AND-gate 801 outputs a LOW signal.

The output of AND-gate 801 is provided as an input to latch circuit 805 which propagates D input to Q output when the clock is LOW. Latch circuit 805 is a level-sensitive half-latch which is active when the clock is at a LOW level. As such, latch circuit 805 can be designed using a half-latch with active LOW clock. Clock signal FRCCLK is used to drive latch circuit 805. The output of latch circuit 805 is provided as an input to AND-gate 802. The other input to AND-gate 802 is clock signal FRCCLK. In so doing, the output of AND-gate 802 can be used as a propagated clock signal which only goes HIGH when the horizontal pixel limit of a tile is reached and clock signal FRCCLK is also HIGH. The propagated clock signal output from AND-gate 802 is provided as a clock signal to latch circuit 806. Horizontal sync signal HSYNC which indicates the start a new display line is provided to latches circuits 805–806 as a reset signal. Hence, at the beginning of each display line, latch circuits 805–806 are reset to zero.

Adder 804 is a 4-bit adder whose output is provided as an input to latch circuit 806. Latch circuit 806 may be a D-type latch or a master-slave type latch. The output of latch circuit 806 is in turn provided as a second input to adder 804. The output of latch circuit 806 is also provided as an input to adder circuit 804. In so doing, when the horizontal pixel boundary of a tile is reached, the horizontal offset is updated by adding the initial horizontal offset INITHO[3:0] using modulo-16 addition. The horizontal offset is reset to zero at the beginning of each display line when HSYNC is active.

Figure 9:
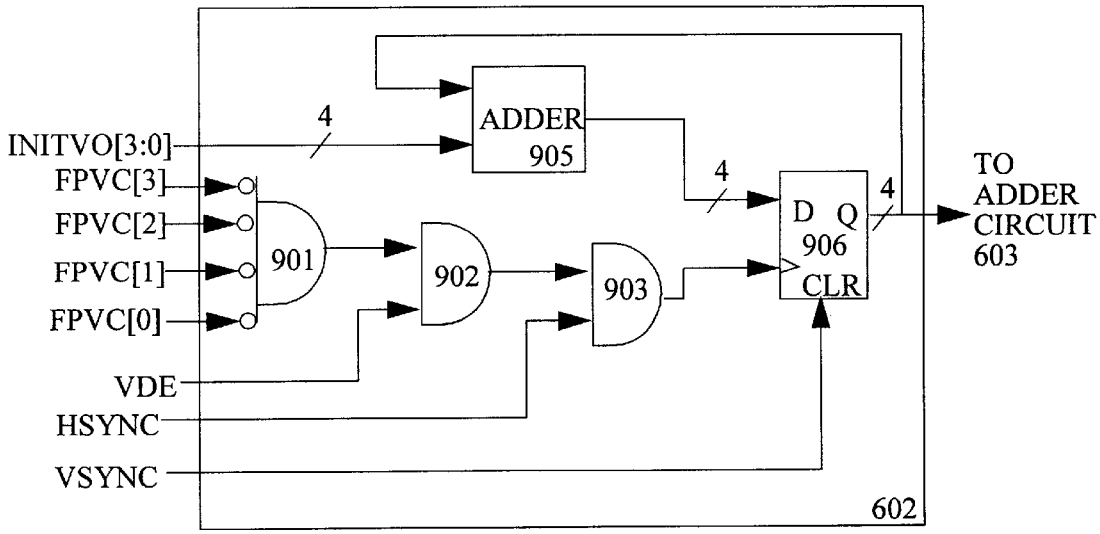
FIG. 9 is a block diagram illustrating vertical offset circuit 602 of FIG. 6 in accordance to the present invention.

Referring to FIG. 9 which illustrates vertical line offset circuit 602. As shown in FIG. 9, vertical line offset circuit 602 consists of AND-gates 901–903, adder 905, and latch circuit 906. Initial vertical line value INITVO[3:0], which is a 4-bit programmable value that can be used to vary the output of vertical line offset circuit 602, is provided as an input to adder 905. The other input to adder 905 is the output of latch circuit 906.

Modulo-16 vertical counter signal FPVC[3:0] is inverted and provided as input to AND-gate 901. When the vertical line count is zero (0), AND-gate 901 outputs a HIGH signal. Otherwise, AND-gate 901 outputs a LOW signal. The output of AND-gate 901 is provided as an input to AND-gate 902 which receives as a second input vertical display enable signal VDE which indicates whether the current line is inside the vertical active display area. If the current line is inside the active display area and the vertical count is zero indicating the beginning of a tile vertical column, AND-gate 902 outputs a HIGH signal. Otherwise, AND-gate 902 outputs a LOW signal. The output of AND-gate 902 is provided as an input to AND-gate 903 which receives as a second input horizontal sync signal HSYNC. Horizontal sync signal HSYNC is used as a 'clock' for the vertical line offset generation.

If the current pixel is inside the active display area and it is the start of tile vertical line, AND-gate 903 outputs a HIGH signal when signal HSYNC goes high to indicate that the vertical offset should be updated to reflect the current vertical position of the tile at hand. Otherwise, AND-gate 903 outputs a LOW signal. The output of AND-gate 903 is used to clock latch circuit 906. Latch circuit 906 can be designed using D-type latches or other master-slave type latches. As discussed earlier, the output of latch circuit 906 is provided as an input to adder 905. In so doing, when the above conditions are met, the vertical offset is updated. The vertical sync signal VSYNC which indicates that the end of a display frame has been reached is provided to latch circuit 906 as a reset signal. Hence, just prior to the start of display frame, the vertical offset is reset to zero.

Figure 10:
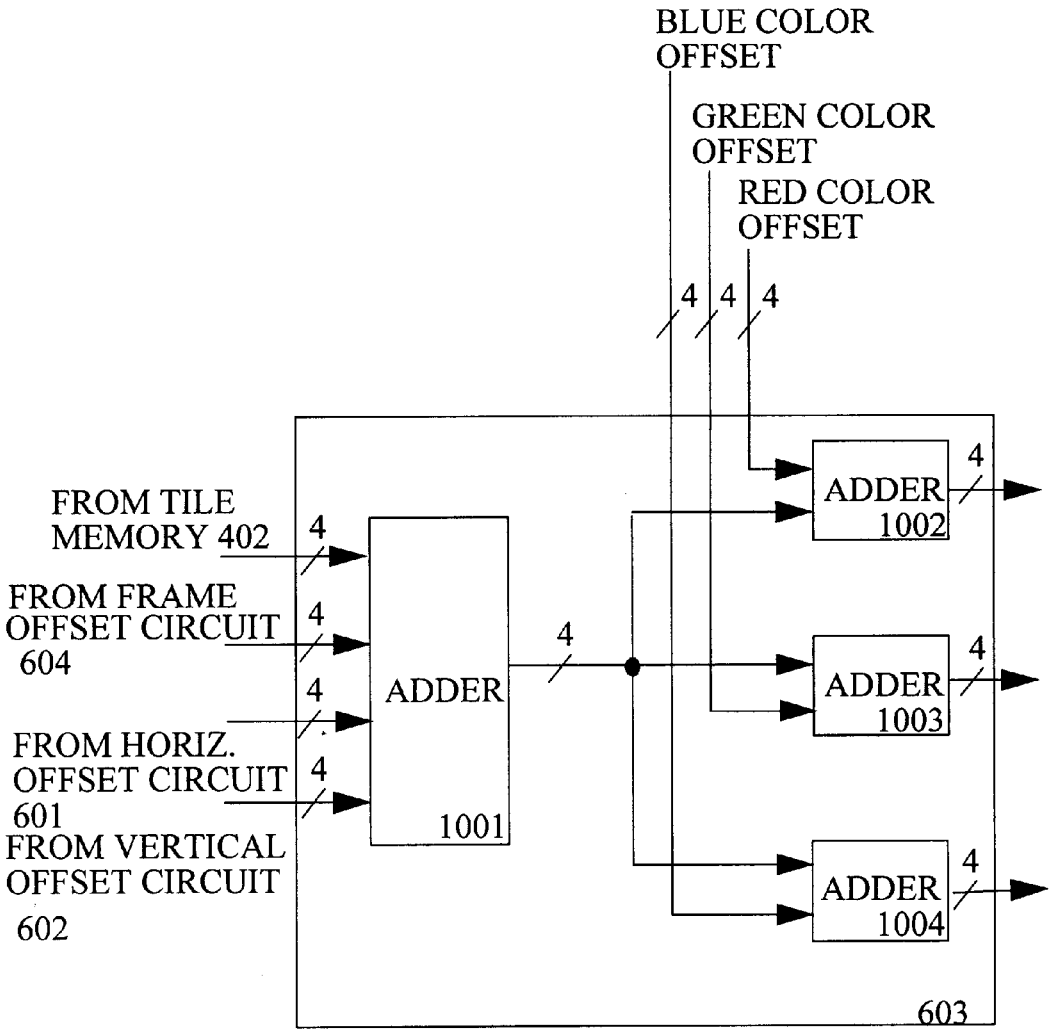
FIG. 10 is a block diagram illustrating adding circuit 603 of FIG. 6 in accordance to the present invention.

FIG. 10 illustrates adder circuit 603 which consists of adding circuits 1001–1004. Adding circuit 1001 receives as inputs frame offset value from frame offset circuit 604, horizontal offset value from horizontal offset circuit 601, vertical line offset value from vertical pixel offset circuit 602, and pixel mapping data from tile memory 402. Adding circuit 1001 performs modulo-16 addition with its inputs to determine a waveform accessing index value. The output of adding circuit 1001 is provided to adders 1002–1004.

Adders 1002–1004, which are modulo-16 adders, are used to determine color-specific (i.e., Red, Green, and Blue) waveform accessing index values. More specifically, adder 1002 is used to combine a Red pixel-color offset value with the waveform accessing index value from adding circuit 1001, adder 1003 is used to combine a Green pixel-color offset value with the waveform accessing index value from latch circuit 1005, and adder 1004 is used to combine a Blue pixel-color offset value with the waveform accessing index value from latch circuit 1005. The color-specific waveform accessing index values are then provided as a select signal to multiplexing circuit 405. The Red, Green, and Blue color offset may be generated from a register that can be programmed with different values.

As discussed above, in accordance to the present invention, the frame offset value, the horizontal pixel offset value, the vertical line offset value, and the color offset values are used as variables in determining the waveform accessing index. Hence, they represent additional programmability features in generating gray scale data. The idea is to make the sequence of the frame modulation appears as random as possible between one pixel and an adjacent pixel in the display panel. All of the programmability features in the present invention can be used to reduce the probability that all the pixels are to be turned on and off concurrently (simultaneously) in the same frame thereby preventing screen flickering. The offset values can all contribute to that goal which goes a long way in making the present invention adaptable to different passive matrix LCD panels.

An embodiment of the present invention, a flexible gray scale shading data generating system, apparatus, and method is thus described. While the present invention has been described in particular embodiments, the present invention should not be construed as limited by such embodiments, but rather construed according to the below claims.

What is claimed is:

1. An apparatus to generate frame-rate modulation data in response to input color pixel data for a digital display having pixels arranged in rows and columns and into tiles each having a predetermined number of pixels, the apparatus comprising:

a first memory receiving as input pixel mapping data, the first memory selectively outputting pixel mapping data received in response to row and column addresses;

an index generating circuit coupled to the first memory, a frame counter, a horizontal pixel counter, and a vertical line counter, the index generating circuit generating a waveform accessing index based on a horizontal pixel count, a vertical line count, a frame count, pixel mapping data output from the first memory, and pixel color offset values;

a second memory for storing a predetermined number of brightness-level waveforms each having a predetermined number of command bits corresponding to the frames in a frame cycle associated with the waveforms; and a multiplexing circuit coupled to the second memory and the index generating circuit, the multiplexing circuit selecting for output a brightness-level waveform from the second memory in response to the waveform accessing index and input pixel color data.

2. The apparatus of claim 1, wherein the input pixel color data is used to access the rows of the second memory and the waveform accessing index is used to access the columns of the second memory.

3. The apparatus of claim 2 further comprising a mode selecting circuit, the mode selecting circuit selecting pixel color data for output to the multiplexing circuit according to a predetermined scheme in response to a mode select signal.

4. The apparatus of claim 3, wherein the predetermined scheme implemented by the mode selecting circuit accommodates 16 possible gray-levels for each color input, if the mode select signal indicates a 16-levels select mode, the mode selecting circuit performing a one-to-one mapping scheme in selecting pixel color data for output wherein a different output binary value is assigned to each input binary value; if the mode select signal indicates a 8-levels select mode, the mode selecting circuit performing a two-to-one mapping scheme in selecting pixel color data for output wherein a specific output binary value is assigned to two designated input binary values; if the mode select signal indicates a 4-levels select mode, the mode selecting circuit performing a four-to-one mapping scheme in selecting pixel color data for output wherein a specific output binary value is assigned to four designated input binary values; and if the mode select signal indicates a 2-levels select mode, the mode selecting circuit performing an eight-to-one mapping scheme in selecting pixel color data for output wherein a specific output binary value is assigned to eight designated input binary values.

5. The apparatus of claim 4, wherein the mode selecting circuit is designed to separately map pixel Red color data, pixel Green color data, and pixel Blue color data.

6. The apparatus of claim 1, wherein the index generating circuit comprising:

a frame offset circuit receiving as inputs a vertical sync signal and a frame count doubling signal, the frame offset circuit generating a frame offset value by adding an offset value to the frame count, wherein the offset value is determined by the frame count doubling signal, wherein the frame offset value is a M-modulo count and M is the number of frames in a cycle;

a horizontal pixel offset circuit receiving as inputs an initial horizontal offset value, the horizontal pixel count, and a horizontal sync signal, wherein the horizontal pixel count is N-modulo where N is the number of data values in each row of the first memory, the horizontal pixel offset circuit determining an updated horizontal offset value;

a vertical line offset circuit receiving as inputs an initial vertical offset value, the vertical line count, the horizontal sync signal, a vertical sync signal, and an active display area signal, wherein the vertical line count is L-modulo where L is the number of data values in each column of the first memory, the vertical line offset circuit determining an updated vertical offset value; and an adder circuit coupled to the frame offset circuit, the horizontal pixel offset circuit, and the vertical pixel offset circuit, the adder circuit further receiving as input pixel color offset values, the adder circuit combining the frame offset value, the updated horizontal offset value, the updated vertical offset value, and the pixel color offset values to determine the waveform accessing index.

7. The apparatus of claim 6, wherein the horizontal pixel offset circuit comprising a M-modulo adder, the M-modulo adder adding the M-modulo initial horizontal offset value to a previously updated horizontal offset value at a horizontal tile boundary to determine the updated horizontal offset value.

8. The apparatus of claim 6, wherein the vertical line offset circuit comprising a M-modulo adder, the M-modulo adder adding a M-modulo initial vertical offset value to a previously updated vertical offset value at a vertical tile boundary to determine the updated vertical offset value.

9. The apparatus of claim 6, wherein the adder circuit comprising:

a M-modulo first adder circuit receiving as inputs the frame offset value, the updated horizontal offset value, the updated vertical offset value, and the selected pixel mapping value, the first adder circuit combining the frame offset value, the updated horizontal offset value, the updated vertical offset value, and the pixel mapping data output from the first memory to determine a combined value; and a M-modulo second adder circuit receiving as inputs the pixel color offset values and the combined value; the second adder combining the pixel color offset values with the latched combined value, to determine the waveform accessing index for use with the second memory.

10. The apparatus of claim 9, wherein the pixel color offset values comprising pixel Red color offset value, pixel Green offset value, and pixel Blue offset value.

11. The apparatus of claim 1, wherein the multiplexing circuit is designed to multiplex pixel Red color data, pixel Green color data, and pixel Blue color data separately.

12. The apparatus of claim 1, wherein the first memory and second memory are random access memories (RAMs).

13. The apparatus of claim 10, wherein the first memory can store N×L cells each having a value ranging from 0-to-(M−1), wherein N and L are the numbers of pixels in the horizontal and vertical direction in each tile, respectively.

14. The apparatus of claim 11, wherein the second memory can store up to (M+1) brightness-level waveforms each having M number of command bits.

15. A computer system comprising:

a central processor;

memory coupled to the central processor;

a memory controller coupled to the central processor;

a display controller coupled to the central processor;

a flat panel interface coupled to the display controller, the flat panel interface comprising a gray scale shading apparatus to generate frame-rate modulation data in response to input color pixel data for a digital display having pixels arranged in rows and columns and into tiles each having a predetermined number of pixels, the apparatus comprising:

a first memory receiving as input pixel mapping data, the first memory selectively outputting pixel mapping data received in response to row and column addresses;

an index generating circuit coupled to the first memory, a frame counter, a horizontal pixel counter, and a vertical line counter, the index generating circuit generating a waveform accessing index based on a horizontal pixel count, a vertical line count, a frame count, pixel mapping data output from the first memory, and pixel color offset values;

a second memory for storing a predetermined number of brightness-level waveforms each having a predetermined number of command bits corresponding to the frames in a frame cycle associated with the waveforms; and a multiplexing circuit coupled to the second memory and the index generating circuit, the multiplexing circuit selecting for output a brightness-level waveform from the second memory in response to the waveform accessing index and input pixel color data.

16. The computer system of claim 15, wherein the input pixel color data is used to access the rows of the second memory and the waveform accessing index are used to access the columns of the second memory.

17. The computer system of claim 16 further comprising a mode selecting circuit, the mode selecting circuit selecting pixel color data for output to the multiplexing circuit according to a predetermined scheme in response to a mode select signal.

18. The computer system of claim 17, wherein the predetermined scheme implemented by the mode selecting circuit accommodates 16 possible gray-levels for each color input, if the mode select signal indicates a 16-levels select mode, the mode selecting circuit performing a one-to-one mapping scheme in selecting pixel color data for output wherein a different output binary value is assigned to each input binary value; if the mode select signal indicates a 8-levels select mode, the mode selecting circuit performing a two-to-one mapping scheme in selecting pixel color data for output wherein a specific output binary value is assigned to two designated input binary values; if the mode select signal indicates a 4-levels select mode, the mode selecting circuit performing a four-to-one mapping scheme in selecting pixel color data for output wherein a specific output binary value is assigned to four designated input binary values; and if the mode select signal indicates a 2-levels select mode, the mode selecting circuit performing an eight-to-one mapping scheme in selecting pixel color data for output wherein a specific output binary value is assigned to eight designated input binary values.

19. The computer system of claim 15, wherein the index generating circuit comprising:

a frame offset circuit receiving as inputs a vertical sync signal and a frame count doubling signal, the frame offset circuit generating a frame offset value by adding an offset value to the frame count, wherein the offset value is determined by the frame count doubling signal, wherein the frame offset value is a M-modulo count and M is the number of frames in a cycle;

a horizontal pixel offset circuit receiving as inputs an initial horizontal offset value, the horizontal pixel count, and a horizontal sync signal, wherein the horizontal pixel count is N-modulo where N is the number of data values in each row of the first memory, the horizontal pixel offset circuit determining an updated horizontal offset value;

a vertical line offset circuit receiving as inputs an initial vertical offset value, the vertical line count, the horizontal sync signal, a vertical sync signal, and an active display area signal, wherein the vertical line count is L-modulo where at L is the number of data values in each column of the first memory, the vertical line offset circuit determining an updated vertical offset value; and an adder circuit coupled to the frame offset circuit, the horizontal pixel offset circuit, and the vertical pixel offset circuit, the adder circuit further receiving as input pixel color offset values, the adder circuit combining the frame offset value, the updated horizontal offset value, the updated vertical offset value, and the pixel color offset values to determine the waveform accessing index.

20. The computer system of claim 19, wherein the horizontal pixel offset circuit comprising a M-modulo adder, the M-modulo adder adding the M-modulo initial horizontal offset value to a previously updated horizontal offset value at a horizontal tile boundary to determine the updated horizontal offset value.

21. The computer system of claim 19, wherein the vertical line offset circuit comprising a M-modulo adder, the M-modulo adder adding a M-modulo initial vertical offset value to a previously updated vertical offset value at a vertical tile boundary to determine the updated vertical offset value.

22. The computer system of claim 19, wherein the adder circuit comprising:

a M-modulo first adder circuit receiving as inputs the frame offset value, the updated horizontal offset value, the updated vertical offset value, and the selected pixel mapping value, the first adder circuit combining the frame offset value, the updated horizontal offset value, the updated vertical offset value, and the output pixel mapping data output from the first memory to determine a combined value; and a M-modulo second adder circuit receiving as inputs the pixel color offset values and the combined value; the second adder combining the pixel color offset values with the latched combined value, to determine the waveform accessing index for use with the second memory.

23. A method to generate frame-rate modulation data in response to input color pixel data for a digital display having pixels arranged in rows and columns and into tiles each having a predetermined number of pixels, the method comprising:

storing input pixel mapping data in a first memory, selectively outputting pixel mapping data from the first memory in response to row and column addresses;

storing a predetermined number of brightness-level waveforms each having a predetermined number of command bits corresponding to the frames in a frame cycle associated with the waveforms in a second memory;

generating a waveform accessing index based on a horizontal pixel count, a vertical line count, a frame count, pixel mapping data, and pixel color offset values; and selecting for output a brightness-level waveform from the second memory in response to the waveform accessing index and pixel color data.

24. The method of claim 23 further comprising the step of selecting pixel color data for output according to a predetermined scheme in response a mode select signal.

* * * * *